US005818394A

United States Patent [19]

Aminzadeh et al.

[11] Patent Number: 5,818,394

[45] Date of Patent: Oct. 6, 1998

[54] FLAT ANTENNA

[75] Inventors: Mehran Aminzadeh, Brunswick; Manfred Burkert, Bockenem; Michael Daginnus, Brunswick; Shun-Ping Chen, Düsseldorf, all of Germany

[73] Assignee: FUBA Automotive GmbH, Bad Salzdetfurth, Germany

[21] Appl. No.: 825,717

[22] Filed: Apr. 4, 1997

[30] Foreign Application Priority Data

Apr. 9, 1996 [DE] Germany ..... 196 14 068.4

[51] Int. Cl.[6] ..... H01Q 1/32

[52] U.S. Cl. ..... 343/713

[58] Field of Search ..... 343/872, 713, 343/766, 702, 881, 700 MS, 749, 846, 720

[56] References Cited

U.S. PATENT DOCUMENTS

| | | | |
|---|---|---|---|
| 4,791,423 | 12/1988 | Yokoyama et al. . | |
| 4,791,426 | 12/1988 | Lindenmeier | 343/713 |
| 4,835,541 | 5/1989 | Johnson et al. . | |
| 5,146,232 | 9/1992 | Nishikawa et al. . | |
| 5,689,271 | 11/1997 | Masahiro et al. | 343/872 |

FOREIGN PATENT DOCUMENTS

| | | |
|---|---|---|
| 537548 | 9/1992 | European Pat. Off. . |
| 3738707 | 5/1989 | Germany . |
| 3738513 | 4/1991 | Germany . |
| 295 02 253.1 | 5/1995 | Germany . |
| 19504577 | 8/1996 | Germany . |
| 7122930 | 5/1995 | Japan . |

OTHER PUBLICATIONS

JP 3–173203A —Patent Abstracts of Japan Oct. 23, 1991, vol. 15, No. 417.

*Primary Examiner*—Frank G. Font
*Assistant Examiner*—Layla G. Wlodkowski
*Attorney, Agent, or Firm*—Collard & Roe, P.C.

[57] ABSTRACT

A flat antenna for mounting on windowpanes of motor vehicles reduces the dimensions of the mass reference area of the mass plane, and the structural height without unfavorably influencing the functions and operating parameters of the antenna. The mass reference area has a trough-like shape, is centrally positioned under an aerial segment, and has conductive coating impermeable to the operating frequency of the antenna. The inside and outside conductors of the coaxial feed cable are connected to the aerial segment and mass reference area shifted to outside the aerial elements and thereby enables a significant reduction in overall dimensions.

12 Claims, 2 Drawing Sheets

FLAT ANTENNA

BACKGROUND OF THE INVENTION

1. Field of the Invention

The present invention relates to flat antennas. More particularly, it relates to a flat antenna for terrestrially emitted signals and radio connections with frequencies in the GHz-range (e.g., L-band reception for DAB), short distance radio connections (ISM-bands with 2.4 and 5.8 GHz), and especially for mobile radio services in the 900 Mhz and 1.8 Ghz bands.

2. The Prior Art

The invention is based on the operating principle described in German Patent Application No. 195 04 577 using typical solutions of the prior state of the art. Two aerial elements having parallel faces relative to each other are electrically connected by a lateral short circuit. Of the two aerial elements, one (the mass reference area) is connected to the outside conductor of the coaxial feed line, and the other (the aerial segment with the contours determining the functions) is connected to the inside conductor of the coaxial feed cable. This configuration forms a hollow-space resonator when in operation. In case of resonance, a field builds up on the open lateral zones, which leads to radial emissions in usable orders of magnitude.

If this arrangement is positioned across a large conductive plane surface, with the side of the mass reference area resting closely against the large conductive plane, or if the mass reference area itself is much larger than the aerial segment connected to the inside conductor, a radiation characteristic similar to that of a monopole is obtained. This creates radiation all around in the horizontal plane (i.e., in the plane of the two aerial elements). The dimensions of the aerial segments connected to the inside conductor normally orientate themselves on the measure of one-quarter of the wavelength corresponding with the mean operating frequency range (i.e., the spacing of the side with the short-circuit connection from the opposite edge).

The mechanical structure, (i.e., the arrangement of the antenna components above a relatively large conductive plane or mass area) and the necessity of such a large area, to begin with, limits the potential applications for this type of antenna, and also constitute a substantial cost factor.

An example of a proposed solution is shown in U.S. Pat. No. 4,835,541. The flat antenna is arranged below the roof shell of a passenger motor vehicle. The roof shell consists of a dielectric material. The aerial segment, representing the mass reference area, rests on a sheet metal plate having larger dimensions than the mass reference area. Underneath the sheet metal plate is a metal foil having the dimensions of the interior roof lining "in order to protect the interior of the vehicle against the electromagnetic field when the antenna is in operation." It can be deduced from the operation principle of this type of antenna that the metal foil with its large area does not solely serve for the protection of the vehicle passengers. In fact, as an important secondary function, it supports the sheet metal plate in its influence on the build-up of the field. In addition, it substantially contributes to enhancing the radiation characteristics and other operating parameters of the system. The use of a flat antenna of this type is therefore limited to structures with surfaces consisting of a conductive material and being as planar as possible.

SUMMARY OF THE INVENTION

The invention is based on the problem of reducing the mechanical dimensions of a flat antenna for use in motor vehicles. Specifically, the flat antenna system of the invention reduces the dimensions of the mass reference area of the mass plane, and the structural height without unfavorably influencing the functions and operating parameters of the antenna.

The flat antenna of the invention retains the characteristic structure of the electromagnetic field above the plane of the mass reference area in the form of cross radiation similar to a monopole.

The antenna according to the invention can be arranged in the top or bottom marginal zone of the front or rear windowpane of a passenger motor vehicle without impairing the vision for the occupants. This is also advantageous for the highly slanted position of the windowpanes of more modern vehicles. The projection of the antenna body in the direction of the occupants view forms a smaller area due to the slanted position of the of the windowpane. The inclination of the windowpane is an important precondition for the flawless function of the antenna as a radio antenna. As a radio antenna, radiation all around is required in the horizontal radiation diagram. This condition can be safely satisfied with the antenna arrangement of the invention where the windowpane has an angle of inclination of up to 400 from the horizontal. The field-forming effect of the trough-like mass reference area is supported in this direction by the neighboring metallic surfaces and parts of the vehicle body.

In accordance with the reduction of the dimensions of the mass reference area, the invention discloses a change in the connection of the coaxial feed to the antenna. In the known state of the art, solutions using standard designs of the aerial elements, for example made from sheet metal, the connections to the outside conductor and to the inside conductor of the feed cable are made within the interior zone of the two aerial elements (i.e., in or close to the center). Due to the shifting of both connection points to the outside of the aerial elements, and by connecting the inside conductor of the cable to the aerial segment via an additional peripheral line piece, it is possible to reduce the spacing between the two aerial elements, and thus the structural height of the entire arrangement by about 30%. This can amount to a 3 to 5 mm reduction in the overall structural height.

The flat antenna according to the invention represents itself as a flat module with relatively small aerial dimensions. If this antenna is positioned in the interior of the vehicle on a front or rear windowpane in the top or bottom marginal zone, the back side of the mass reference area is visible from the interior, and from this perspective is curved slightly convex, or tapered towards its edges.

The emission of HF-energy into the interior of the vehicle is eliminated by the curvature of the mass reference area, such that even during the transmitting operation within relatively large volume supply cells, the physiologically harmless, standardized values of electromagnetic compatibility (EMC) are never exceeded. The possibility of making the windowpane impermeable to the wave conforming to the radio frequency within the surroundings of the mass reference area with conductive coatings is an additional measure known per se, which can be used in order to eliminate final safety concerns and to optimize the radiation characteristics even further.

The antenna of the invention can be used just as effectively in sites other than motor vehicles.

It is therefore an object of the present invention to provide a flat antenna that overcomes the drawbacks of the prior art.

It is another object of the invention to provide a flat antenna that achieves superior operating characteristics while being physically small.

It is yet a further object of the invention to provide a flat antenna for mounting on a front or rear windowpane of a motor vehicle without obstructing the site of the vehicle operator.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
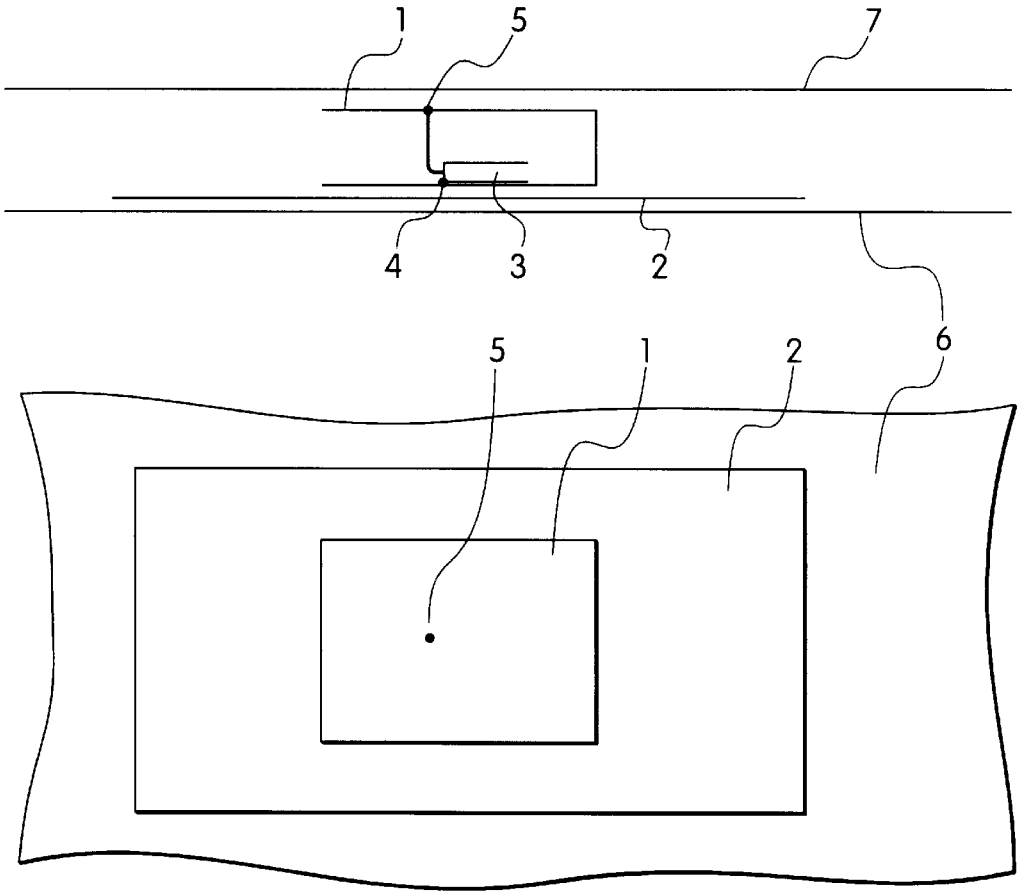
Fig. 1 (Prior Art)
FIG. 1 is a conventional flat antenna of the prior art.

Turning now in detail to the drawings, FIG. 1 shows an antenna according to the prior art disclosed in U.S. Pat. No. 4,835,541. The antenna consists of a sheet metal strip 1 bent in a U-shape with equal size upper and lower legs, and a sheet metal plate 2 disposed under the lower leg of the U-shaped strip 1. Each of the upper and lower legs has an operating frequency range of 800–900 Mhz and dimensions of 7.62×8.71 cm. The distance between the legs is 12.7 mm, and the sheet metal plate 2 is 25.4×33.18 cm.

The outside conductor of feed cable 3 is connected to the lower leg of metal strip 1 at connection point 4, and the inside conductor is connected to the upper leg at feed connection point 5. A metal foil 6 is arranged beneath sheet metal plate 2, and is intended to screen off the interior of the vehicle. The foil 6 has the same dimensions as the interior lining of the roof below the foil, and serves to terminate the structure. The roof shell 7 is made of plastic.

Figure 2:
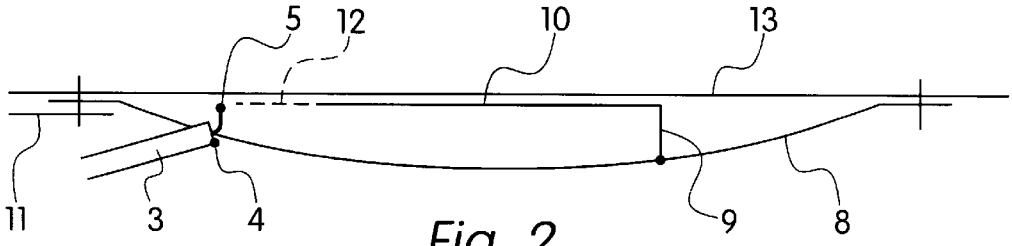
FIG. 2 is a sectional view of the flat antenna according to the present invention.

FIG. 2 illustrates the principle of the present invention. The mass plane is reduced to a trough-like mass reference area 8. Mass reference area 8 consists of sheet metal or a plastic bowl-like surface that is coated with a conductive material on the concave side, and also serves as a housing part for the antenna. Within the marginal zone of its edge, aerial segment 10 is connected to the conductive material of the mass reference area 8 via a short circuit connection 9. Mass reference area 8 is electrically and mechanically connected to the vehicle mass 11. Aerial segment 10 is connected to the inside conductor of feed cable 3, beyond the edge opposing the short circuit connection 9, via an additional conductor part 12. Conductor part 12 can be designed by extending the inside conductor of feed cable 3 and bending it at a right angle. A dielectric cover or hood 13 is provided with the antenna installation. Cover or hood 13 can be an outer body part of the motor vehicle, such as, for example, windowpane 15.

Figure 3A:
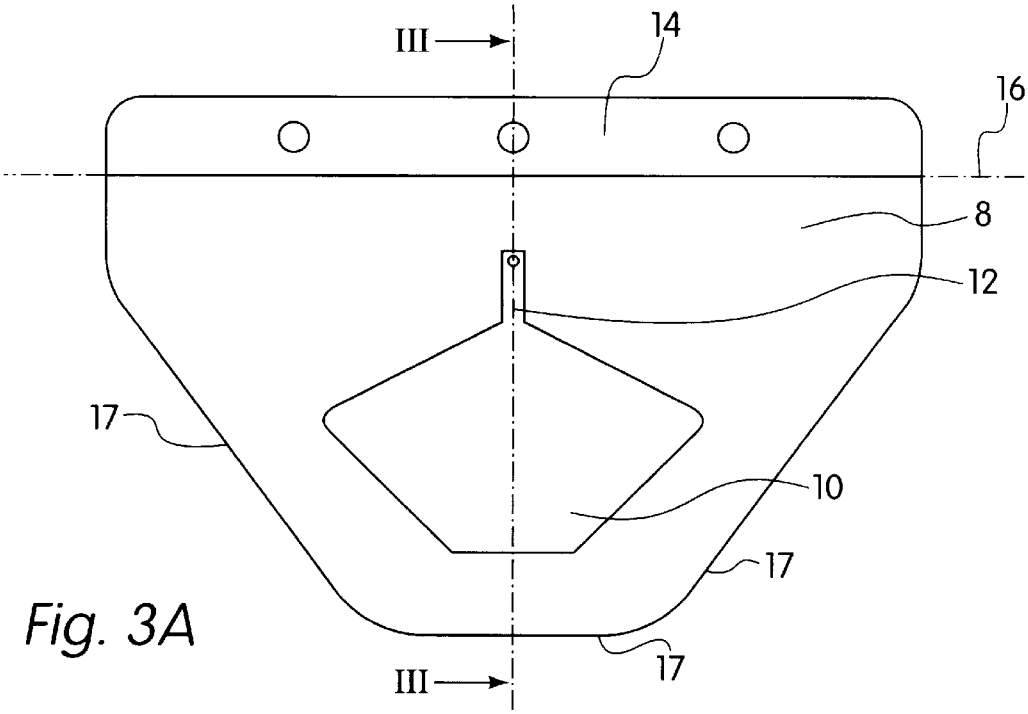
FIG. 3*a* is a plan view of the flat antenna according to the invention.
Figure 3B:
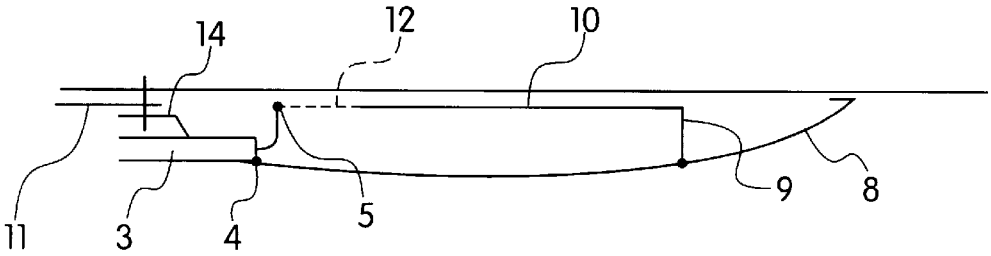
FIG. 3*b* is a cross-sectional view of the antenna of FIG. 3*a* taken along lines III—III.
Figure 3C:
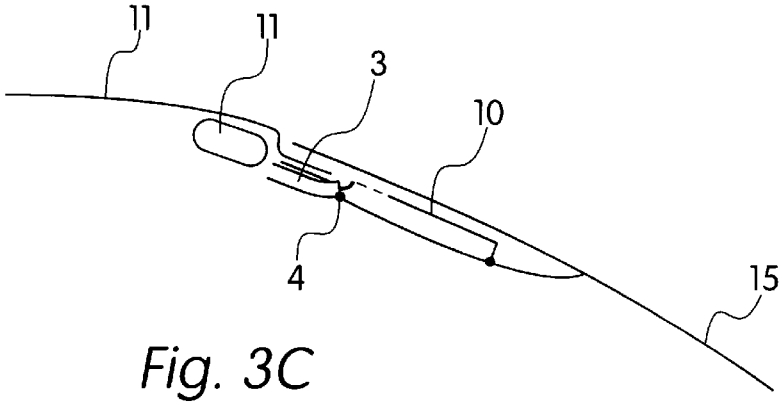
FIG. 3*c* is a sectional view of the flat antenna of the invention as mounted within a motor vehicle.

FIGS. 3*a*–3*c* show a practical embodiment for mounting the antenna behind the front or rear windowpane of a passenger automobile. The conductive material of mass reference area 8 is connected to vehicle mass 11 via flange 14. Edge 16 represents the edge of the windowpane framing under which edge flange 14 is disposed. Thus, when positioned accordingly, the remainder of mass reference area 8 extends into the zone of the window.

The antenna of the invention is mounted on front or rear windowpane 15 in a marginal zone thereof. The inclination of windowpane 15 is an important precondition for the flawless function of the antenna as a radio antenna. As a radio antenna, radiation all around is requires in the horizontal radiation diagram. In more modern vehicles, the inclination of windowpane 15 is more pronounced, and further accommodates the antenna of the invention. An acceptable range of inclination for windowpane 15 is up to 40° from the horizontal.

Mass reference area 8 and aerial segment have marginal zones disposed around their respective edges for receiving connections to feed cable 3. The edges 17 of mass reference area 8 are contoured and adapted to the shape of aerial segment 10. The contoured edges 17 are designed to create an equally spaced zone between aerial segment 10 and the outer edges 17 of mass reference area 8. The edges 17 rest on the dielectric body part 13 or windowpane 15 such that it abuts said parts (13, 15) as a low bridge at an obtuse angle.

Aerial segment 10 is centrally disposed above mass reference area 8, and is designed to have dimensions that in accordance with a one-quarter the wavelength corresponding with the mean operating frequency range. Thus, mass reference area 8 and aerial segment 10 are said to have an aerial content ratio of 4:1.

In the exemplified embodiment of a motor vehicle antenna for 900 Mhz operations, conductor part 12 has a length of 18 mm and the spacing of aerial segment 10 from mass reference area 8 amounts to approximately 10 mm in its marginal zone. The spacing can be reduced further by extending conductor part 12, which represents an inductance. Furthermore, it is conceivable to replace conductor part 12 with a coil. Using a coil would also obtain an comparable effect of measure or dimension reduction.

All measurement, measurement ratios and parameters of the antenna have to be optimized in each case through individual designs and adaptations depending on several factors and conditions of the particular application. Examples of these factors and conditions would be frequency range and required bandwidth, adaptation to networks extending further, as well as the materials being used and ambient constructions and structures.

While one embodiment of the present invention have been shown and described, it is to be understood that many changes and modifications may be made thereunto without departing from the spirit and scope of the invention as defined in the appended claims.

What is claimed is:

1. A flat antenna for frequencies in the Ghz range comprising:

a first planar aerial segment (10) having an electrically conductive surface and marginal zones with edges;

a second electrically conductive surface forming a mass reference area (8) disposed below said aerial segment, said mass reference area (8) having marginal zones with opposite side edges curved upwardly to form a flat trough-like shape beneath said aerial segment (10), said aerial segment (10) being conductively connected to said mass reference area (8) within its marginal zone via a short circuit connection (9), said mass reference area being mass connected along one edge to a large metallic vehicle mass (11);

said mass reference area (8) and said aerial segment (10) having an aerial content ratio of 4:1, respectively, wherein said aerial segment (10) is centrally disposed above said mass reference area (8);

a coaxial feed cable (3) having an inside conductor and an outside conductor, said inside conductor being connected to said aerial segment (10) and said outside conductor being connected to said mass reference area (8).

2. The flat antenna according to claim 1, wherein the connection of said inside conductor with said aerial segment (10) further comprises a line piece (12) having one end connected to an edge of said aerial segment (10) opposite said short circuit connection (9), and an opposite end projecting beyond the edge of said aerial segment (10).

3. The flat antenna according to claim 1, wherein the connection of the inside conductor with said aerial segment (10) is performed by extending and exposing a portion of the inside conductor and connecting the end to said aerial segment (10) as an extension of the plane of said aerial segment.

4. The flat antenna according to claim 2, further comprising:

a dielectric outer body vehicle part (13, 15) electrically connected to said mass reference area (8), said outer body part (13, 15) being inclined with respect to the horizontal by no more than 40°, and said mass reference area (8) being disposed underneath and partially resting against said dielectric vehicle body part (13, 15);

a flange (14) disposed along one edge of said mass reference area (8), said flange (14) connecting said mass reference area (8) to a metallic body part (11) of the vehicle body, the remaining marginal zones of said mass reference area (8) resting against an interior surface of said outer body part (13, 15).

5. The flat antenna according to claim 1, wherein said mass reference area (8) is positioned such that an upper marginal zone is electrically connected to the vehicle mass (11) and positioned in a top zone of a windowpane (15), the remaining marginal zones of the edges resting against the windowpane.

6. The flat antenna according to claim 1, wherein said mass reference (8) area further comprises outer contoured edges (17) adapted to the shape of said aerial segment (10) such that an equally spaced zone is created between said aerial segment (10) and the outer edges (17) of said mass reference area (8).

7. The flat antenna according to claim 1, wherein the short circuit connection (9) is disposed on a side of said mass reference area (8) that is remote from the mass connection.

8. The flat antenna according to claim 6, wherein said edges (17) abut the dielectric body part (13, 15) as a low bridge at an obtuse angle with respect to said body parts.

9. The flat antenna according to claim 1, said aerial segment (10) and said mass reference area (8) are structured from molded elements made of dielectric material.

10. The flat antenna according to claim 9, wherein said conductive surfaces of said aerial segment (10) and said mass reference area (8) are formed using a method selected from the group consisting of spray-application, inter-joining of metallic foils, and foils with conductive coating.

11. The flat antenna according to claim 1, wherein said outer body parts (13, 15) within the environment of said mass reference area (8) are provided with a coating that is impermeable to a wavelength corresponding to the operation frequency and represents a continuation of said mass reference area (8).

12. The flat antenna according to claim 11, wherein said coating on said outer body parts (13, 15) is a coating selected from the group consisting of a conductive coating and thin conductor trains.

* * * * *